US010569185B2

(12) United States Patent
Hoenigschmid

(10) Patent No.: US 10,569,185 B2
(45) Date of Patent: Feb. 25, 2020

(54) THREE-DIMENSIONAL GEOMETRIC ART TOY

(71) Applicant: Andreas Hoenigschmid, Los Angeles, CA (US)

(72) Inventor: Andreas Hoenigschmid, Los Angeles, CA (US)

( * ) Notice: Subject to any disclaimer, the term of this patent is extended or adjusted under 35 U.S.C. 154(b) by 0 days.

(21) Appl. No.: 14/487,219

(22) Filed: Sep. 16, 2014

(65) Prior Publication Data

US 2016/0074765 A1 Mar. 17, 2016

(51) Int. Cl.
*A63H 33/04* (2006.01)
*A63H 33/26* (2006.01)

(52) U.S. Cl.
CPC ..... *A63H 33/046* (2013.01); *A63H 33/26* (2013.01)

(58) Field of Classification Search
CPC ..... A63H 33/04; A63H 33/046; A63H 33/26
See application file for complete search history.

(56) References Cited

U.S. PATENT DOCUMENTS 2,570,625 A * 10/1951 Zimmerman ..... A63H 33/046 446/92
3,095,668 A * 7/1963 Dorsett ..... A63H 33/046 446/92
3,254,440 A * 6/1966 Duggar ..... A63H 33/046 446/92
3,645,535 A * 2/1972 Randolph ..... A63F 9/12 273/157 R
3,662,486 A * 5/1972 Freedman ..... A63F 9/088 446/120
4,258,479 A * 3/1981 Roane ..... A63H 33/046 434/211
4,334,870 A * 6/1982 Roane ..... A63H 33/046 434/211
4,334,871 A * 6/1982 Roane ..... A63H 33/046 434/211
4,392,323 A 7/1983 Rubik
(Continued)

FOREIGN PATENT DOCUMENTS

GB 2064844 A * 6/1981 ..... G09B 23/04
GB 2064844 A * 6/1981 ..... G09B 23/04
GB 2107200 A * 4/1983 ..... A63H 33/04

*Primary Examiner* — Eugene L Kim
*Assistant Examiner* — Alyssa M Hylinski
(74) *Attorney, Agent, or Firm* — Christensen O'Connor Johnson Kindness PLLC

(57) ABSTRACT

A geometric art toy (10) comprises a plurality of first toy members (312A) and a plurality of second toy members (312B). Each first toy member (312A) includes a plurality of first magnets (314A) that are oriented to exhibit a first polarity. Each second toy member (312B) includes a plurality of second magnets (314B) that are oriented to exhibit a second polarity that is substantially opposite to the first polarity. Each first toy member (312A) is movably coupled to another first toy member (312A) and one of the plurality of second toy members (312B). Each of the first toy members (312A) and the second toy members (312B) are formed in a shape of a tetrahedron. The first magnets (314A) and the second magnets (314B) enable the geometric art toy (10) to be alternatively and stably positioned in a first configuration and a second configuration that is different than the first configuration.

11 Claims, 15 Drawing Sheets

(56) References Cited

U.S. PATENT DOCUMENTS

| | | | | | |
|---|---|---|---|---|---|
| 4,722,712 | A * | 2/1988 | McKenna | A63H 33/10 | 273/155 |
| 4,886,273 | A * | 12/1989 | Unger | A63F 9/12 | 273/157 R |
| 5,009,625 | A * | 4/1991 | Longuet-Higgins | A63H 33/046 | 434/211 |
| 5,193,809 | A | 3/1993 | Hrsel et al. | | |
| 5,199,711 | A | 4/1993 | Pataki et al. | | |
| 5,249,966 | A * | 10/1993 | Hiigli | G09B 23/04 | 434/211 |
| 5,299,804 | A * | 4/1994 | Stevens | A63F 9/088 | 273/155 |
| 5,660,387 | A | 8/1997 | Stokes | | |
| 5,746,638 | A * | 5/1998 | Shiraishi | A63H 33/046 | 446/131 |
| 6,017,220 | A * | 1/2000 | Snelson | A63H 33/046 | 434/211 |
| 6,257,574 | B1 | 7/2001 | Evans | | |
| 6,264,199 | B1 * | 7/2001 | Schaedel | A63F 9/088 | 273/155 |
| 8,061,713 | B2 * | 11/2011 | Cook | A63F 9/1204 | 273/156 |
| 8,087,671 | B2 | 1/2012 | Houlis | | |
| 8,157,608 | B1 | 4/2012 | Stapleton | | |
| 2008/0274665 | A1 * | 11/2008 | Cheng | A63H 33/08 | 446/118 |
| 2010/0225057 | A1 | 9/2010 | Akiyama et al. | | |

* cited by examiner

THREE-DIMENSIONAL GEOMETRIC ART TOY

BACKGROUND

In geometry, a tetrahedron is a polygonal solid figure having six edges and four triangular surfaces, three of which meet at each of four corners or vertices. The tetrahedron is unique in that all other polygonal solid figures can be broken down into a plurality of tetrahedrons. Thus, a number of different polygonal solid shapes and/or configurations can be produced by manipulating or assembling a plurality of tetrahedrons relative to one another. In different applications, such a plurality of tetrahedrons can be viewed as an educational device for the study of polygonal solids, or as a puzzle or toy that can be used for entertainment or amusement. Additionally, some people may view the various polygonal solid shapes or configurations that can be formed as a form of art that can be displayed for others to see. In any of these applications, it can be desired to stably maintain the plurality of tetrahedrons in any of various configurations.

SUMMARY

The present invention is directed toward a geometric art toy (also referred to herein simply as an "art toy") comprising a plurality of first toy members and a plurality of second toy members. Each first toy member includes a plurality of first magnets that are oriented to exhibit a first polarity. Additionally, each second toy member includes a plurality of second magnets that are oriented to exhibit a second polarity that is substantially opposite to the first polarity. Further, each first toy member is movably coupled to another first toy member and one of the plurality of second toy members.

Moreover, in one embodiment, each second toy member is movably coupled to another second toy member and one of the plurality of first toy members.

In certain embodiments, each of the first toy members is formed in a shape of a first tetrahedron, and each of the second toy members is formed in a shape of a second tetrahedron. In one such embodiment, the shape of the first tetrahedron is substantially identical to the shape of the second tetrahedron. Additionally, in one embodiment, the first tetrahedron has six edges. In such embodiment, the relative lengths of the six edges are such that a first edge has a first length of one unit, a second edge has a second length of one unit, a third edge has a third length of the square root of two ($\sqrt{2}$) units, a fourth edge has a fourth length of one-half the square root of three ($\sqrt{3}/2$) units, a fifth edge has a fifth length of one-half the square root of three ($\sqrt{3}/2$) units, and a sixth edge has a sixth length of one-half the square root of three ($\sqrt{3}/2$) units.

Additionally, in some embodiments, the geometric art toy can be selectively and alternatively positioned in a first configuration and a second configuration that is different than the first configuration. In one such embodiment, the plurality of first magnets interact with the plurality of second magnets such that the geometric art toy can be stably maintained in each of the first configuration and the second configuration.

In one embodiment, each of the first toy members is a tetrahedron including four surfaces, and the first toy member includes three first magnets. In such embodiment, one of the first magnets is coupled to the interior of each of three of the four surfaces.

Additionally, in one embodiment, the geometric art toy includes six first toy members and six second toy members.

Further, in one embodiment, the geometric art toy further comprises a display support that supports the first toy members and the second toy members relative to a surface.

The present invention is further directed toward a toy assembly comprising a plurality of geometric art toys of claim 1 that are selectively, magnetically coupled to one another.

In another representative application, the present invention is directed toward a geometric art toy comprising (i) a plurality of first toy members, each first toy member being formed in the shape of a first tetrahedron; and (ii) a plurality of second toy members that are movably coupled to the plurality of first toy members, each second toy member being formed in the shape of a second tetrahedron; wherein the shape of the first tetrahedron is substantially identical to the shape of the second tetrahedron, each of the first tetrahedrons and each of the second tetrahedrons has six edges, and the relative lengths of the six edges of each of the first tetrahedrons and the second tetrahedrons are such that a first edge has a first length of one unit, a second edge has a second length of one unit, a third edge has a third length of the square root of two ($\sqrt{2}$) units, a fourth edge has a fourth length of one-half the square root of three ($\sqrt{3}/2$) units, a fifth edge has a fifth length of one-half the square root of three ($\sqrt{3}/2$) units, and a sixth edge has a sixth length of one-half the square root of three ($\sqrt{3}/2$) units.

In still another representative application, the present invention is directed toward a geometric art toy comprising (i) a plurality of first toy members, each first toy member being formed in the shape of a first tetrahedron, each first toy member including three first magnets that are oriented to exhibit a first polarity, each first toy member including four surfaces, with one of the first magnets being coupled to the interior of each of three of the four surfaces; and (ii) a plurality of second toy members that are movably coupled to the plurality of first toy members, each second toy member being formed in the shape of a second tetrahedron, each second toy member including three second magnets that are oriented to exhibit a second polarity that is substantially opposite to the first polarity, each second toy member including four surfaces, with one of the second magnets being coupled to the interior of each of three of the four surfaces; wherein the shape of the first tetrahedron is substantially identical to the shape of the second tetrahedron, each of the first tetrahedrons and each of the second tetrahedrons has six edges, and the relative lengths of the six edges of each of the first tetrahedrons and the second tetrahedrons are such that a first edge has a first length of one unit, a second edge has a second length of one unit, a third edge has a third length of the square root of two ($\sqrt{2}$) units, a fourth edge has a fourth length of one-half the square root of three ($\sqrt{3}/2$) units, a fifth edge has a fifth length of one-half the square root of three ($\sqrt{3}/2$) units, and a sixth edge has a sixth length of one-half the square root of three ($\sqrt{3}/2$) units; and wherein each first toy member is movably coupled to another first toy member and one of the plurality of second toy members, and each second toy member is movably coupled to another second toy member and one of the plurality of first toy members.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1A:
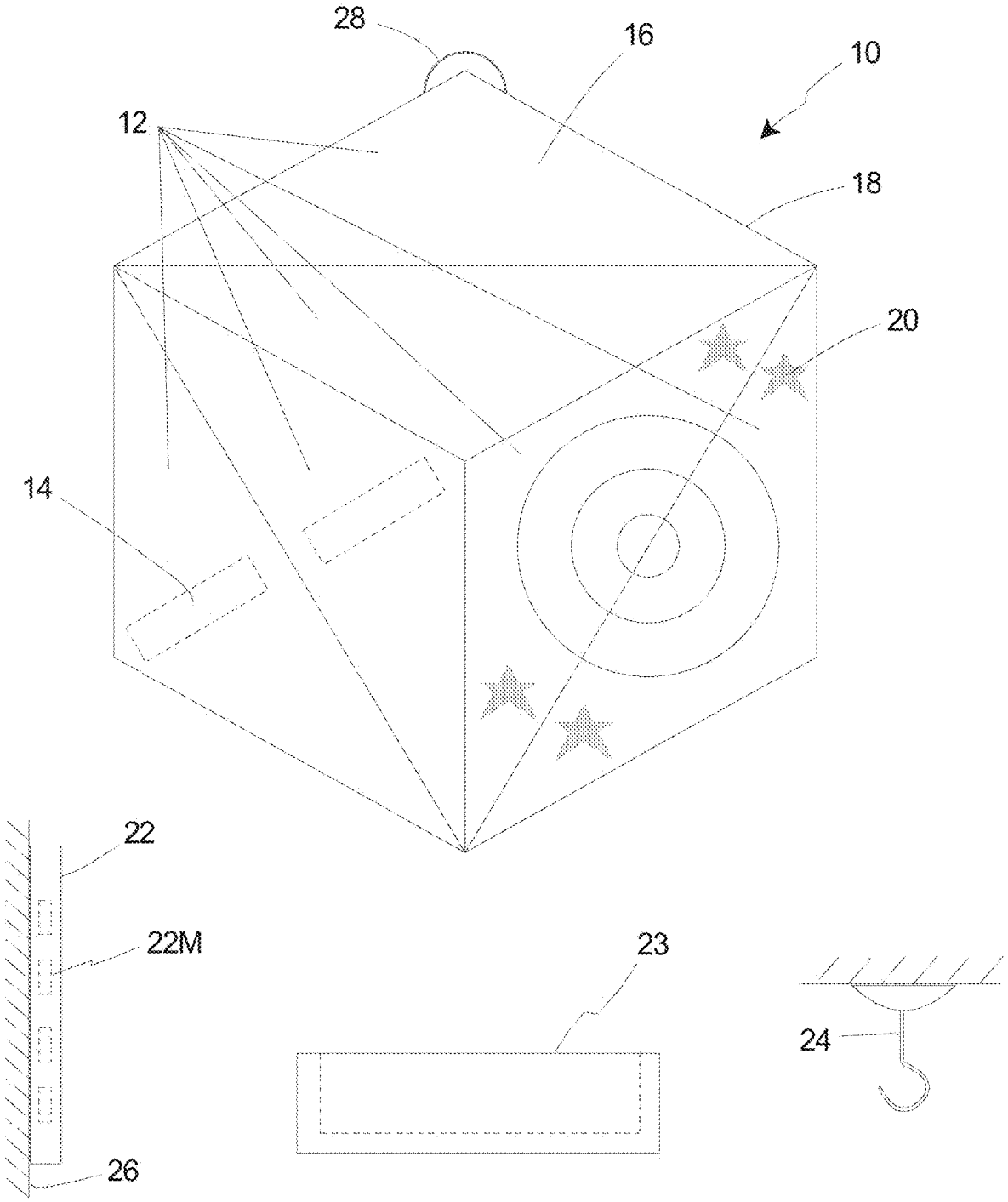
FIG. 1A is a perspective view of a geometric art toy having features of the present invention, shown in a first configuration.
Figure 1B:
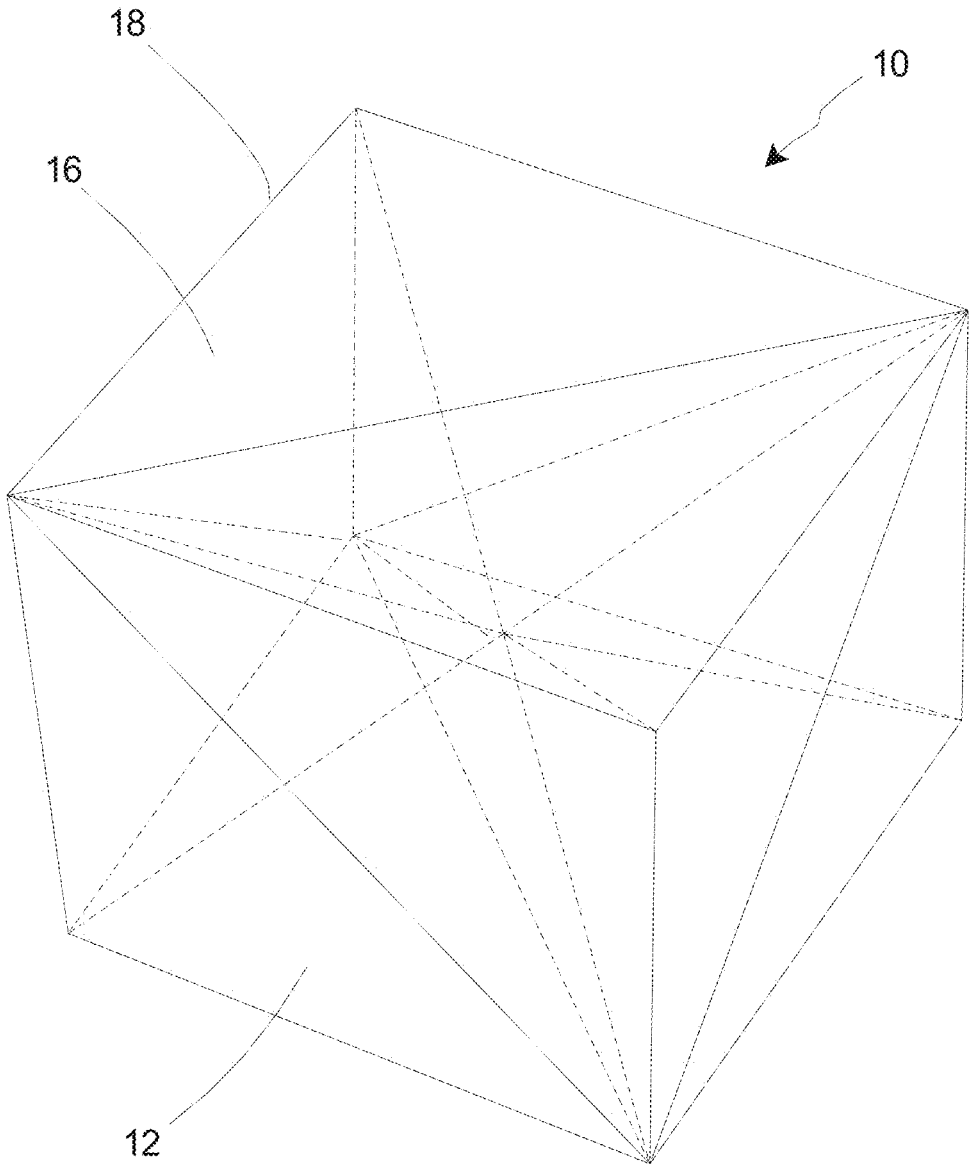
FIG. 1B is another perspective view of the geometric art toy illustrated in FIG. 1A.

FIG. 1A is a perspective view of a three-dimensional, geometric art toy 10 (also sometimes referred to herein simply as an "art toy") having features of the present invention. Additionally, FIG. 1B is another perspective view of the geometric art toy 10 illustrated in FIG. 1A. In particular, FIG. 1B more clearly illustrates (in phantom) certain features of the art toy 10.

The design of the art toy 10 can be varied as desired. In certain embodiments, as illustrated, the art toy 10 is comprised of a plurality of toy members 12 (some of which and/or portions of which are illustrated in phantom in FIG. 1B) that are movably, e.g., hingedly, coupled to one another. For example, in one such embodiment, the art toy 10 can comprise twelve toy members 12 that are each movably coupled to two adjacent toy members 12. Additionally, in some embodiments, each of the toy members 12 can be formed in the shape of a tetrahedron (or a three-sided pyramid, with a base). Alternatively, the art toy 10 can include greater than or less than twelve toy members 12, one or more of the toy members 12 can be movably coupled to more than two adjacent two members 12 or only one adjacent toy member 12, and/or one or more of the toy members 12 can be formed in another suitable shape.

As an overview, as described in greater detail herein below, the art toy 10 is designed to be selectively and stably positioned in a plurality of alternative configurations. Additionally, as illustrated herein, various such configurations can by substantially symmetrical about one or more axes that extend through a center of the configuration. More particularly, as shown, the art toy 10 includes the plurality of toy members 12 that are coupled to one another and that are movable relative to one another such that the art toy 10 can be selectively and stably positioned in the plurality of alternative configurations. For example, FIGS. 1A and 1B illustrate the art toy 10 and/or the toy members 12 being positioned in a first configuration, i.e. a cube configuration. Further, in addition to each of the toy members 12 being movably, e.g., hingedly, coupled to one or more adjacent toy members 12, each of the toy members 12 also includes one or more magnets 14 (two magnets 14 of which are illustrated in phantom in FIG. 1A) that are positioned and oriented so as to effectively stabilize the art toy 10 and/or the toy members 12 relative to one another when the art toy 10 and/or the toy members 12 are positioned in any of the plurality of alternative configurations.

Still further, as provided herein, in certain embodiments, a plurality of art toys 10 can be utilized together as part of a toy assembly 1200 (illustrated in FIG. 12), i.e. the plurality of art toys 10 can be selectively coupled together to form the toy assembly 1200 that can selectively and stably positioned in various other configurations. More particularly, the precise positioning and orientation of the magnets 14, as disclosed in greater detail herein below, enables each of the art toys 10 in to be positioned in any of the various individual configurations disclosed herein, and to be subsequently selectively and stably coupled to one or more additional art toys 10 to provide the toy assembly 1200 that can be selectively and stably positioned in various additional, alternative configurations.

In one embodiment, as illustrated in FIG. 1, each of the toy members 12 can be substantially identical in size and design, with the exception of the positioning and orientation of the one or more magnets 14. For example, in one embodiment, each of the toy members 12 can be formed as a tetrahedron, having four triangle-shaped surfaces 16 and six edges 18 that are sized to enable the art toy 10 to be positioned in the cube configuration with no interior voids or cavities within the cube. Moreover, in some embodiments, the art toy 10 can include one or more designs or indicia 20 that are included on one or more of the surfaces 16 of each toy member 12.

As further illustrated in FIG. 1A, when the user desires to display the art toy 10, e.g., as a work of art, the art toy 10 can further include a display support, e.g., a display base 22, a display box 23 and/or a display hanger 24, that can be used to support the art toy 10, i.e. the toy members 12, relative to a surface 26, e.g., the ground, a wall, a ceiling, a table top, a counter top, or another surface.

It should be appreciated that the display support, e.g., the display base 22, the display box 23 and/or the display hanger 24, can have any suitable design that is able to support the art toy 10 relative to the surface 26. For example, in certain embodiments, the display base 22 can be a rectangular or square-shaped plate that can be placed on and/or affixed to the surface 26, e.g., with nails or screws. Additionally, the display base 22 can include one or more support magnets 22M (illustrated in phantom) that interact with the magnets 14 of the art toy 10 to support the art toy 10 relative to the surface 26. In some embodiments, the display base 22 is sized to be no larger than the art toy 10 so that the display base 22 does not interfere with the display of the art toy 10.

Somewhat similarly, the display box 23 can be a rectangular or square-shaped box that can be placed on and/or affixed to the surface 26, e.g., with nails or screws. Additionally, the display box 23 can have an opening that is sized and shaped to effectively receive and display the art toy 10 as desired.

Further, as shown, the display hanger 24 can be a hook that can be mounted on the surface 26. Additionally and/or alternatively, the display hanger 24 can include a thin string or rope having a tensile strength that is sufficient to support the weight of the art toy 10. Further, in one embodiment, the display hanger 24 can be adapted to engage a connector 28 that can be selectively or fixedly secured to one or more of the surfaces of the art toy 10. It should be appreciated that the connector 28 can have any suitable design that enables the art toy 10 to be stably supported relative to the surface 26. For example, the connector 28 can include one or more hanger members that can be used to selectively support the art toy 10 from the top, the bottom and/or the sides of the art toy 10 when the art toy 10 is displayed as desired.

Figure 2A:
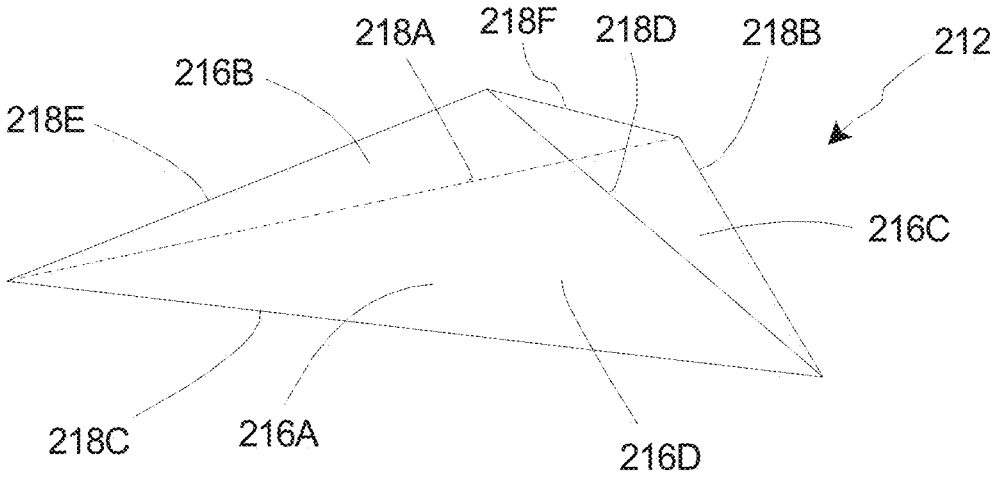
FIG. 2A is a perspective view of an embodiment of a toy member that can be used as part of the geometric art toy illustrated in FIG. 1A.

FIG. 2A is a perspective view of an embodiment of a toy member 212 that can be used as part of the geometric art toy 10 illustrated in FIG. 1A. For example, as noted above, the art toy 10 can be comprised of twelve toy members 212 that are substantially identical in size and design, with the possible exception of the positioning and orientation of the one or more magnets 14 (illustrated, for example, in FIG. 1A).

As shown in FIG. 2A, the toy member 212 can be formed as a tetrahedron having four triangle-shaped surfaces, i.e. a first surface 216A, a second surface 216B, a third surface 216C and a fourth surface 216D, and six edges, i.e. a first edge 218A, a second edge 218B, a third edge 218C, a fourth edge 218D, a fifth edge 218E and a sixth edge 218F. In one embodiment, using a length measurement of one unit as a base, the edges 218A-218F can be sized with the first edge 218A being one (1) unit, the second edge 218B being one (1) unit, the third edge 218C being the square root of two ($\sqrt{2}$) units, the fourth edge 218D being one-half the square root of three ($\sqrt{3}/2$) units, the fifth edge 218E being one-half the square root of three ($\sqrt{3}/2$) units, and the sixth edge 218F being one-half the square root of three ($\sqrt{3}/2$) units. With this design, as noted above, the twelve toy members 212, i.e. the twelve tetrahedrons, can be effectively formed into the cube configuration with no interior voids or cavities within the cube, such as shown in FIG. 1B. More specifically, the first surface 216A of the toy member 212 can be bounded by the first edge 218A being one (1) unit, the second edge 218B being one (1) unit, and the third edge 218C being the square root of two ($\sqrt{2}$) units, with the first surface 216A forming one triangle-shaped half of one of the outer surfaces of the cube. Additionally, the other surfaces 216B, 216C, 216D of the toy member 212 can be oriented to extend into the interior of the cube when the art toy 10 and/or the toy members 212 are positioned in the cube configuration. Alternatively, the edges 218A-218F can be designed to be different lengths relative to one another.

It should be appreciated that the use of the terms "first surface", "second surface", "third surface" and "fourth surface" is merely for purposes of description and ease of illustration, and any of the surfaces 216A-216D can be referred to as the "first surface", the "second surface", the "third surface" and/or the "fourth surface". Similarly, it should also be appreciated that the use of the terms "first edge", "second edge", "third edge", "fourth edge", "fifth edge" and "sixth edge" is merely for purposes of description and ease of illustration, and any of the edges 218A-218F can be referred to as the "first edge", the "second edge", the "third edge" the "fourth edge", the "fifth edge" and/or the "sixth edge".

Figure 2B:
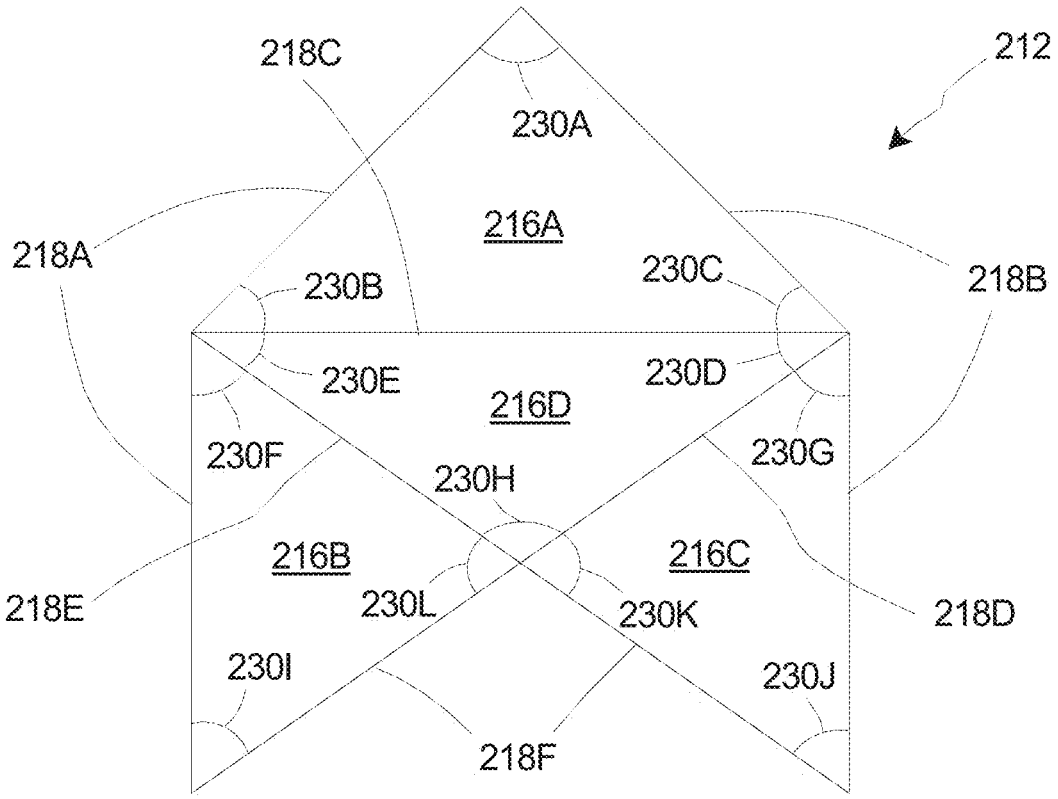
FIG. 2B is a simplified schematic top view of the toy member illustrated in FIG. 2A prior to the toy member being formed into a shape of a tetrahedron.

FIG. 2B is a simplified schematic top view of the toy member 212 illustrated in FIG. 2A prior to the toy member 212 having been formed into the shape of the tetrahedron. More specifically, FIG. 2B illustrates a two-dimensional layout of the surfaces 216A-216D and the edges 218A-218F relative to one another that can be used as a template for forming the toy member 212, prior to the toy member 212 actually being positioned and/or formed into the shape of the tetrahedron.

It should be appreciated that as illustrated in FIG. 2B, the two edges labeled as the first edge 218A will be positioned together as a single edge when the toy member 212 is formed into the shape of a tetrahedron. Similarly, it should be appreciated that as illustrated in FIG. 2B, the two edges labeled as the second edge 218B will be positioned together as a single edge when the toy member 212 is formed into the shape of a tetrahedron. Moreover, it should also be appreciated that as illustrated in FIG. 2B, the two edges labeled as the sixth edge 218F will be positioned together as a single edge when the toy member 212 is formed into the shape of a tetrahedron.

In addition to the lengths of each of the edges 218A-218F, as noted above, and the size of each of the triangle-shaped surfaces 216A-216D, FIG. 2B also illustrates the angles that exist between each of the adjacent edges 218A-218F. More particularly, with the six edges 218A-218F having the sizes as specifically noted above, the angles between the edges 218A-218F are as follows: (i) a first angle 230A between the first edge 218A and the second edge 218B is approximately 90 degrees; (ii) a second angle 230B between the first edge 218A and the third edge 218C is approximately 45 degrees; (iii) a third angle 230C between the second edge 218B and the third edge 218C is approximately 45 degrees; (iv) a fourth angle 230D between the third edge 218C and the fourth edge 218D is approximately 35.26 degrees; (v) a fifth angle 230E between the third edge 218C and the fifth edge 218E is approximately 35.26 degrees; (vi) a sixth angle 230F between the first edge 218A and the fifth edge 218E is approximately 54.74 degrees; (vii) a seventh angle 230G between the second edge 218B and the fourth edge 218D is approximately 54.74 degrees; (viii) an eighth angle 230H between the fourth edge 218D and the fifth edge 218E is approximately 109.47 degrees; (ix) a ninth angle 230I between the first edge 218A and the sixth edge 218F is approximately 54.74 degrees; (x) a tenth angle 230J between the second edge 218B and the sixth edge 218F is approximately 54.74 degrees; (xi) an eleventh angle 230K between the fourth edge 218D and the sixth edge 218F is approximately 70.53 degrees; and (xii) a twelfth angle 230L between the fifth edge 218E and the sixth edge 218F is approximately 70.53 degrees.

It should be appreciated that the use of the terms "first angle" through "twelfth angle" is merely for purposes of description and ease of illustration, and any of the angles 230A-230L can be referred to as any of the "first angle" through the "twelfth angle".

Additionally, it should also be appreciated that in forming the toy member 212 into the shape of a tetrahedron from a two-dimensional layout such as illustrated in FIG. 2B, the tetrahedron, i.e. the toy member 212, will be formed with a hollow interior. Alternatively, the toy member 212 can be formed into the shape of a tetrahedron in a different manner, and/or the toy member 212 can be formed without a hollow interior.

Figure 2C:
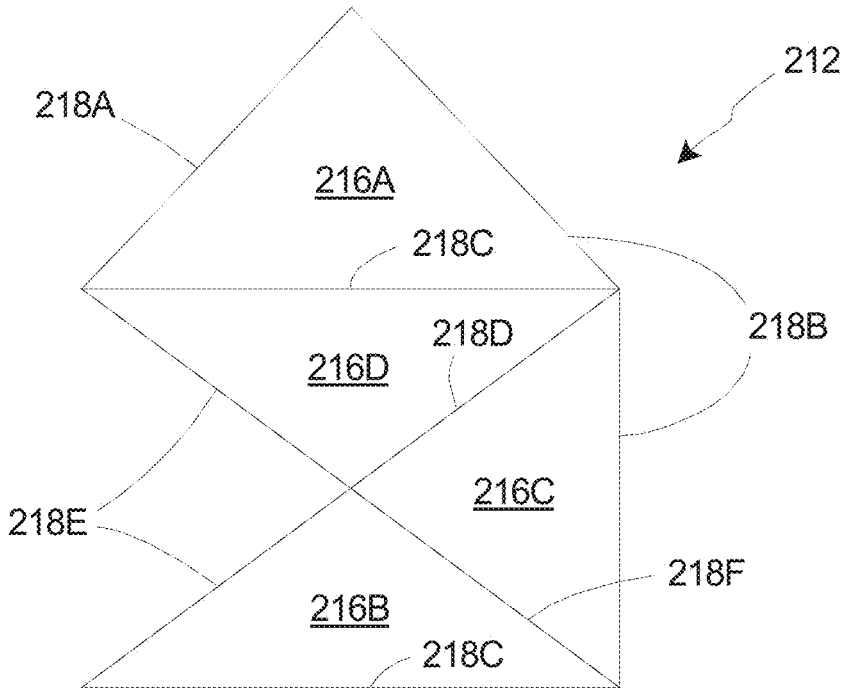
FIG. 2C is another simplified schematic top view of the toy member illustrated in FIG. 2A prior to the toy member being formed into the shape of the tetrahedron.

FIG. 2C is another simplified schematic top view of the toy member 212 illustrated in FIG. 2A prior to the toy member 212 having been formed into the shape of the tetrahedron. More specifically, FIG. 2C illustrates an alternative two-dimensional layout of the surfaces 216A-216D and the edges 218A-218F relative to one another that can be used as a template for forming the toy member 212, prior to the toy member 212 actually being positioned and/or formed into the shape of the tetrahedron.

It should be appreciated that as illustrated in FIG. 2C, the two edges labeled as the second edge 218B will be positioned together as a single edge when the toy member 212 is formed into the shape of a tetrahedron. Similarly, it should be appreciated that as illustrated in FIG. 2C, the two edges labeled as the third edge 218C will be positioned together as a single edge when the toy member 212 is formed into the shape of a tetrahedron. Moreover, it should also be appreciated that as illustrated in FIG. 2C, the two edges labeled as the fifth edge 218E will be positioned together as a single edge when the toy member 212 is formed into the shape of a tetrahedron.

Figure 2D:
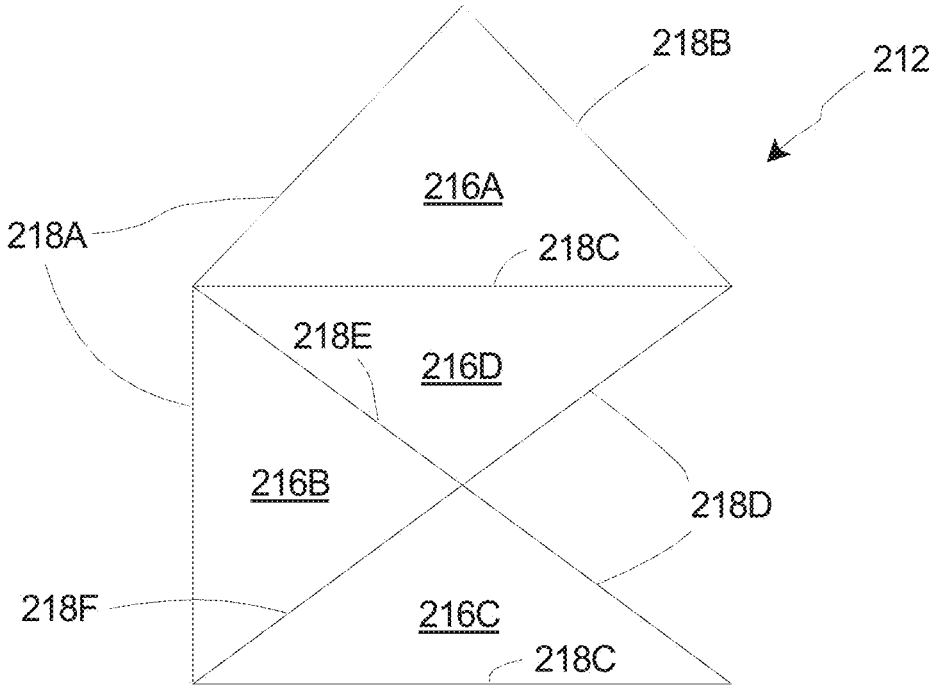
FIG. 2D is still another simplified schematic top view of the toy member illustrated in FIG. 2A prior to the toy member being formed into the shape of the tetrahedron.

FIG. 2D is still another simplified schematic top view of the toy member 212 illustrated in FIG. 2A prior to the toy member 212 having been formed into the shape of the tetrahedron. More specifically, FIG. 2D illustrates another alternative two-dimensional layout of the surfaces 216A-216D and the edges 218A-218F relative to one another that can be used as a template for forming the toy member 212, prior to the toy member 212 actually being positioned and/or formed into the shape of the tetrahedron.

It should be appreciated that as illustrated in FIG. 2D, the two edges labeled as the first edge 218A will be positioned together as a single edge when the toy member 212 is formed into the shape of a tetrahedron. Similarly, it should be appreciated that as illustrated in FIG. 2D, the two edges labeled as the third edge 218C will be positioned together as a single edge when the toy member 212 is formed into the shape of a tetrahedron. Moreover, it should also be appreciated that as illustrated in FIG. 2D, the two edges labeled as the fourth edge 218D will be positioned together as a single edge when the toy member 212 is formed into the shape of a tetrahedron.

Figure 3A:
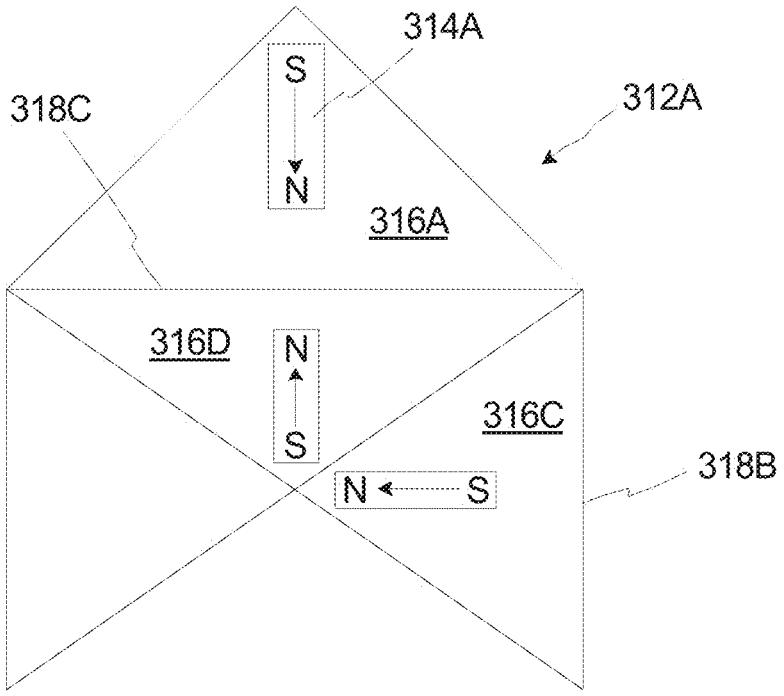
FIG. 3A is a simplified schematic top view of the toy member illustrated in FIG. 2A, including one or more first magnets.

FIG. 3A is a simplified schematic top view of a toy member, i.e. a first toy member 312A, similar to the toy member 212 as illustrated in FIG. 2A, the first toy member 312A including one or more first magnets 314A. In one embodiment, as illustrated in FIG. 3A, the first toy member 312A can include three first magnets 314A, with one first magnet 314A being coupled to each of the first surface 316A, the third surface 316C and the fourth surface 316D. Alternatively, the first toy member 312A can include greater than three or less than three first magnets 314A, and/or one or more of the first magnets 314A can be coupled to another surface of the first toy member 312A.

The size, shape, orientation and polarity of the first magnets 314A can be varied to suit the specific requirements of the first toy member 312A and/or the art toy 10 (illustrated in FIG. 1A). For example, in one embodiment, the first magnets 314A can be bar magnets that are oriented as shown, i.e. with the north poles (shown with an "N") and the south poles (shown with an "S") oriented as illustrated. More particularly, in this embodiment, (i) the first magnet 314A coupled to the first surface 316A is oriented with the north pole facing toward the third edge 318C; (ii) the first magnet 314A coupled to the third surface 316C is oriented with the south pole facing toward the second edge 318B; and (iii) the first magnet 314A coupled to the fourth surface 316D is oriented with the north pole facing toward the third edge 318C. Alternatively, the first magnets 314A can have a different design and/or the first magnets 314A can be oriented in a different manner than specifically shown in FIG. 3A, i.e. to achieve a different polarity for the first magnets 314A. Additionally, in some embodiments, each of the first magnets 314A can be designed to have a magnetic strength of at least approximately one pound. Alternatively, the first magnets 314A can be designed to exhibit a different magnetic strength.

In one embodiment, each of the first magnets 314A can be coupled to a surface of the first toy member 312A within the interior (i.e. an inner surface) of the first toy member 312A when the first toy member 312A is formed into the shape of a tetrahedron. With this design, the first magnets 314A may not be visible to the user, and thus may not impact the appearance of the first toy member 312A and/or the art toy 10. Alternatively, one or more of the first magnets 314A can be coupled to an outer or exterior surface of the first toy member 312A when the first toy member 312A is formed into the shape of a tetrahedron.

Figure 3B:
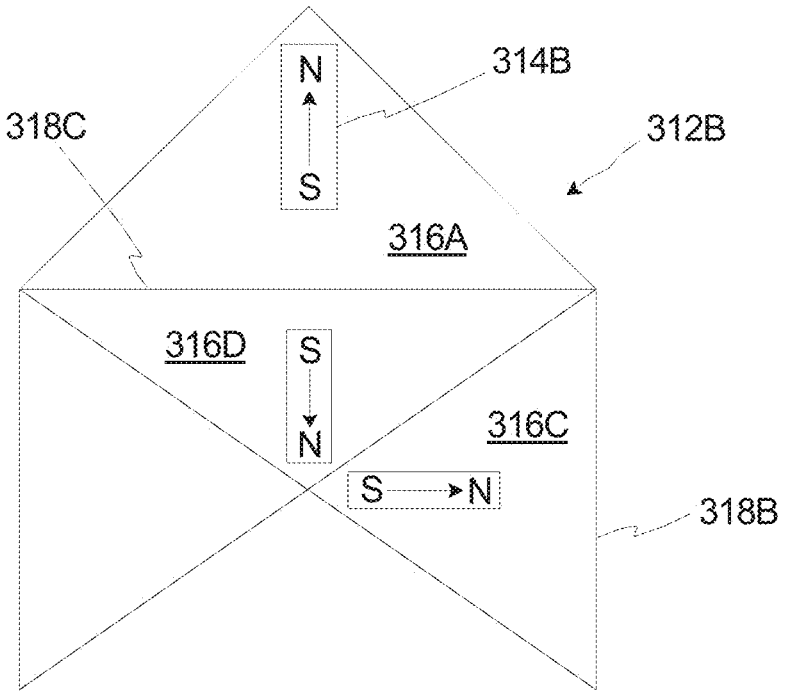
FIG. 3B is a simplified schematic top view of the toy member illustrated in FIG. 2A, including one or more second magnets.

FIG. 3B is a simplified schematic top view of a toy member, i.e. a second toy member 312B, again similar to the toy member 212 as illustrated in FIG. 2A, the second toy member 312B including one or more second magnets 314B. In one embodiment, as illustrated in FIG. 3B, the second toy member 312B can include three second magnets 314B, with one second magnet 314B being coupled to each of the first surface 316A, the third surface 316C and the fourth surface 316D. Alternatively, the second toy member 312B can include greater than three or less than three second magnets 314B, and/or one or more of the second magnets 314B can be coupled to another surface of the second toy member 312B.

The size, shape, orientation and polarity of the second magnets 314B can be varied to suit the specific requirements of the second toy member 312B and/or the art toy 10 (illustrated in FIG. 1A). For example, in one embodiment, the second magnets 314B can be bar magnets that are oriented as shown, i.e. with the north poles (shown with an "N") and the south poles (shown with an "S") oriented as illustrated. More particularly, in this embodiment, (i) the second magnet 314B coupled to the first surface 316A is oriented with the south pole facing toward the third edge 318C; (ii) the second magnet 314B coupled to the third surface 316C is oriented with the north pole facing toward the second edge 318B; and (iii) the second magnet 314B coupled to the fourth surface 316D is oriented with the south pole facing toward the third edge 318C. Alternatively, the second magnets 314B can have a different design and/or the second magnets 314B can be oriented in a different manner than specifically shown in FIG. 3B, i.e. to achieve a different polarity for the second magnets 314B. Additionally, in some embodiments, each of the second magnets 314B can be designed to have a magnetic strength of at least approximately one pound. Alternatively, the second magnets 314B can be designed to exhibit a different magnetic strength.

In one embodiment, each of the second magnets 314B can be coupled to a surface of the second toy member 312B within the interior (i.e. an inner surface) of the second toy member 312B when the second toy member 312B is formed into the shape of a tetrahedron. With this design, the second magnets 314B may not be visible to the user, and thus may not impact the appearance of the second toy member 312B and/or the art toy 10. Alternatively, one or more of the second magnets 314B can be coupled to an outer or exterior surface of the second toy member 312B when the second toy member 312B is formed into the shape of a tetrahedron.

It should be appreciated that in comparing the first toy member 314A illustrated in FIG. 3A and the second toy member 314B illustrated in FIG. 3B, the orientation and, thus, the polarity of the first magnets 314A of the first toy member 312A is substantially directly opposite to that of the orientation and polarity of the second magnets 314B of the second toy member 312B. With this design, in conjunction with the specific movable coupling of a plurality of first toy members 312A and a plurality of second toy members 312B to form the art toy 10, as described in greater detail herein below, the art toy 10 can be stably positioned and maintained in each of the alternative configurations as illustrated herein.

Moreover, as further provided herein, the precise positioning and orientation of the first magnets 314A of the first toy member 312A and the second magnets 314B of the second toy member 312B enable the assembled art toy 10 (illustrated in FIG. 1) to be subsequently selectively and stably coupled to one or more additional art toys 10 to provide the toy assembly 1200 (illustrated in FIG. 12) that can be selectively and stably positioned in various additional, alternative configurations.

Additionally, it should be appreciated that the use of the terms "first toy member" and "second toy member" is merely for purposes of description and ease of illustration, and any of the toy members 312A, 312B can be referred to as the "first toy member" and/or the "second toy member". Similarly, it should also be appreciated that the use of the terms "first magnets" and "second magnets" is merely for purposes of description and ease of illustration, and any of the magnets 314A, 314B can be referred to as the "first magnets" and/or the "second magnets".

Figure 4A:
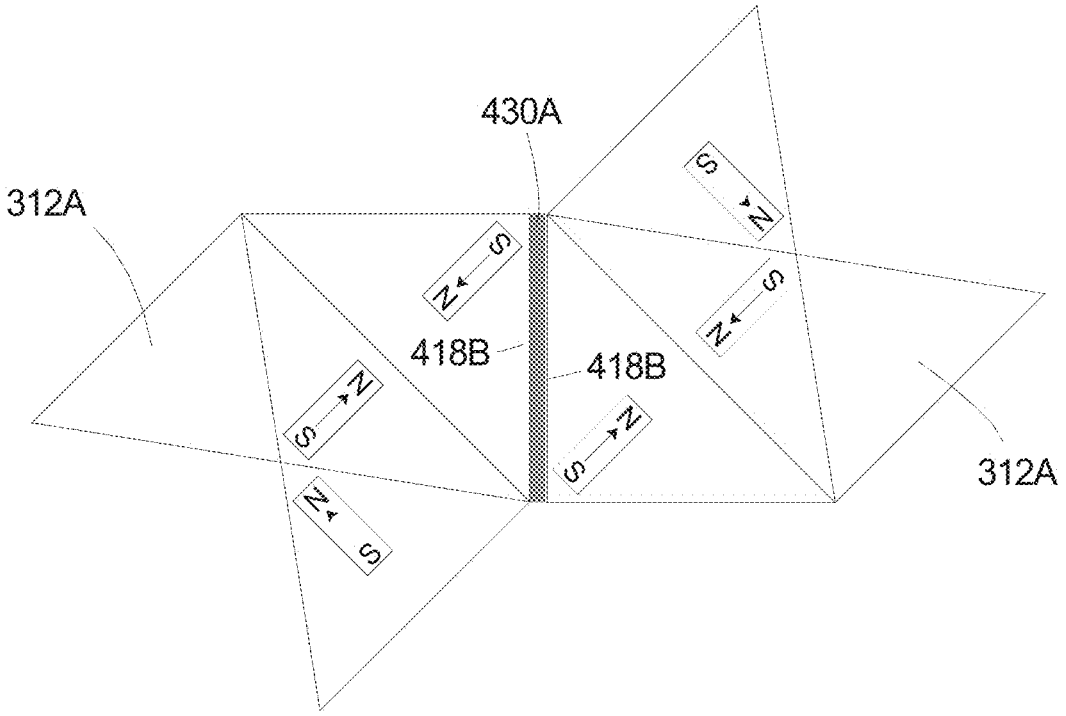
FIG. 4A is a simplified schematic top view of two toy members illustrated in FIG. 2A that are movably coupled to one another with a first flexible connector.

FIG. 4A is a simplified schematic top view of two toy members, i.e. two first toy members 312A illustrated in FIG. 3A, that are movably coupled to one another with a first flexible connector 430A, e.g., a first hinge. More particularly, FIG. 4A illustrates that the first flexible connector 430A is utilized to movably couple together the second edge 418B of one first toy member 312A with the second edge 418B of another first toy member 312A. Stated in another manner, when two first toy members 312A are positioned substantially adjacent to one another, and are thus coupled to one another, the first flexible connector 430A is positioned to movably couple together the second edges 418B of the adjacent first toy members 312A.

The first flexible connector 430A can have any suitable design that enables the adjacent first toy members 312A to pivot relative to one another along the second edges 418B of each of the first toy members 312A. For example, in certain non-exclusive alternative embodiments, the first flexible connector 430A can be formed from a flexible adhesive, such as different types of tape and/or vinyl stickers. Alternatively, the first flexible connector 430A can be formed in another suitable manner.

Figure 4B:
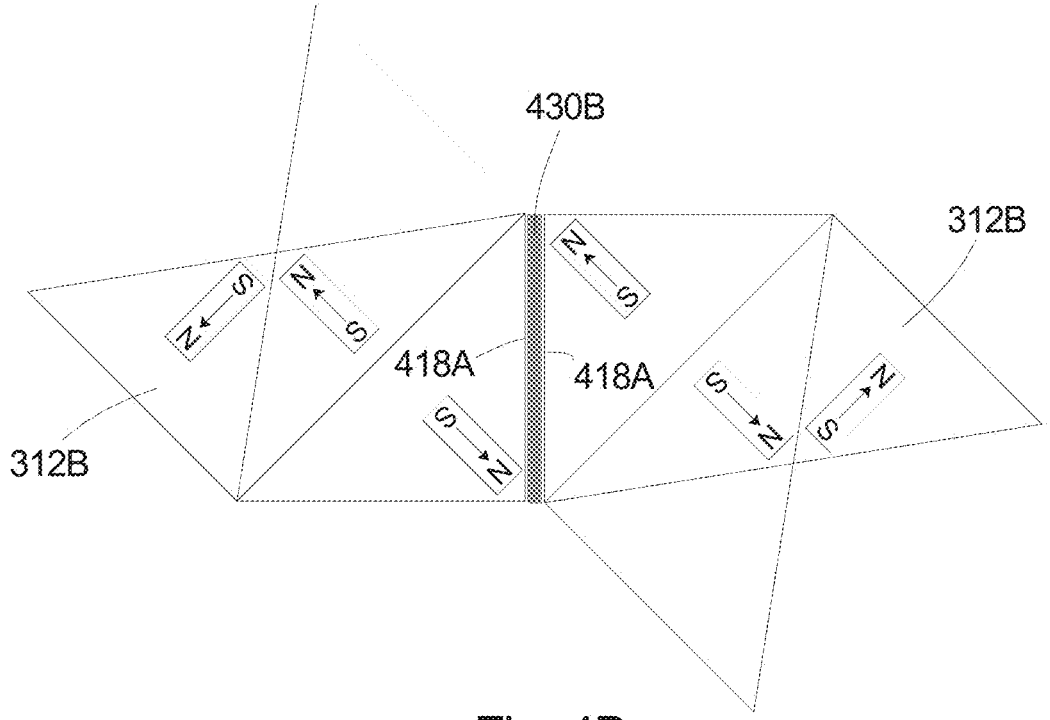
FIG. 4B is a simplified schematic top view of two toy members illustrated in FIG. 2A that are movably coupled to one another with a second flexible connector.

FIG. 4B is a simplified schematic top view of two toy members, i.e. two second toy members 312B illustrated in FIG. 3B, that are movably coupled to one another with a second flexible connector 430B, e.g., a second hinge. More particularly, FIG. 4B illustrates that the second flexible connector 430B is utilized to movably couple together the first edge 418A of one second toy member 312B with the first edge 418A of another second toy member 312B. Stated in another manner, when two second toy members 312B are positioned substantially adjacent to one another, and are thus coupled to one another, the second flexible connector 430B is positioned to movably couple together the first edges 418A of the adjacent second toy members 312B.

The second flexible connector 430B can have any suitable design that enables the adjacent second toy members 312B to pivot relative to one another along the first edges 418A of each of the second toy members 312B. For example, in certain non-exclusive alternative embodiments, the second flexible connector 430B can be formed from a flexible adhesive, such as different types of tape and/or vinyl stickers. Alternatively, the second flexible connector 430B can be formed in another suitable manner.

Figure 4C:
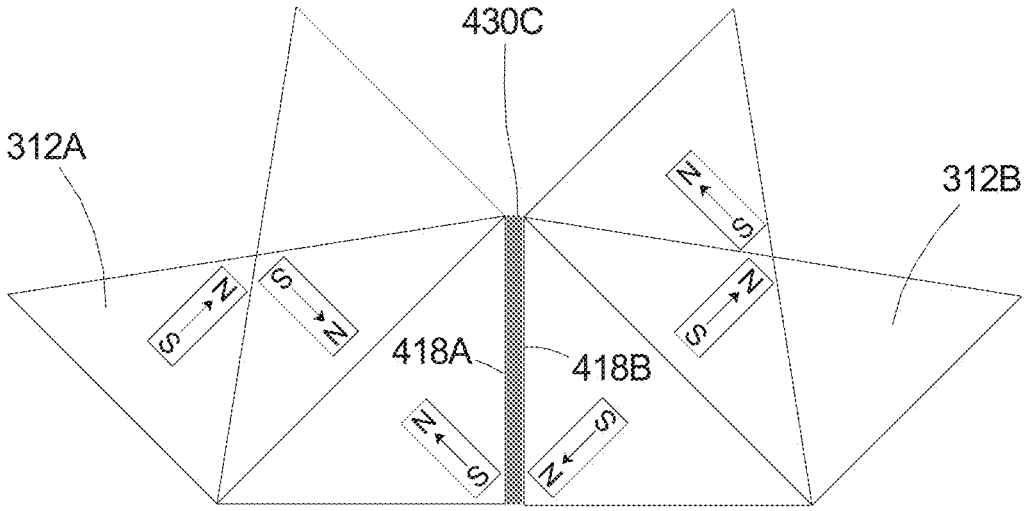
FIG. 4C is a simplified schematic top view of two toy members illustrated in FIG. 2A that are movably coupled to one another with a third flexible connector.

FIG. 4C is a simplified schematic top view of two toy members, i.e. a first toy member 312A of FIG. 3A and a second toy member 312B illustrated in FIG. 3B, that are movably coupled to one another with a third flexible connector 430C, e.g., a third hinge. More particularly, FIG. 4C illustrates that the third flexible connector 430C is utilized to movably couple together the first edge 418A of the first toy member 312A with the second edge 418B of the second toy member 312B. Stated in another manner, when a first toy member 312A and a second toy member 312B are positioned substantially adjacent to one another, and are thus coupled to one another, the third flexible connector 430C is positioned to movably couple together the first edge 418A of the first toy member 312A and the second edge 418B of the adjacent second toy member 312B.

The third flexible connector 430C can have any suitable design that enables the adjacent first toy member 312A and second toy member 312B to pivot relative to one another along the first edge 418A and the second edge 418B, respectively, of each of the toy members 312A, 312B. For example, in certain non-exclusive alternative embodiments, the third flexible connector 430B can be formed from a flexible adhesive, such as different types of tape and/or vinyl stickers (or stickers formed from other suitable materials). Alternatively, the third flexible connector 430C can be formed in another suitable manner.

When FIGS. 4A-4C are viewed in conjunction with one another, it should be understood that (i) each first toy member 312A can be flexibly connected along the first edge 418A to the second edge 418B of an adjacent second toy member 312B (i.e. with a third flexible connector 430C), and along the second edge 418B to the second edge 418 of an adjacent first toy member 312A (i.e. with a first flexible connector 430A); and (ii) each second toy member 312B can be flexibly connected along the first edge 418A to the first edge 418A of an adjacent second toy member 312B (i.e. with a second flexible connector 430B), and along the second edge 418B to the first edge 418A of an adjacent first toy member 312A (i.e. with a third flexible connector 430C).

It should be appreciated that the use of the terms "first flexible connector", "second flexible connector" and "third flexible connector" is merely for purposes of description and ease of illustration, and any of the flexible connectors 430A, 430B, 430C can be referred to as the "first flexible connector" the "second flexible connector" and/or the "third flexible connector".

Figure 5:
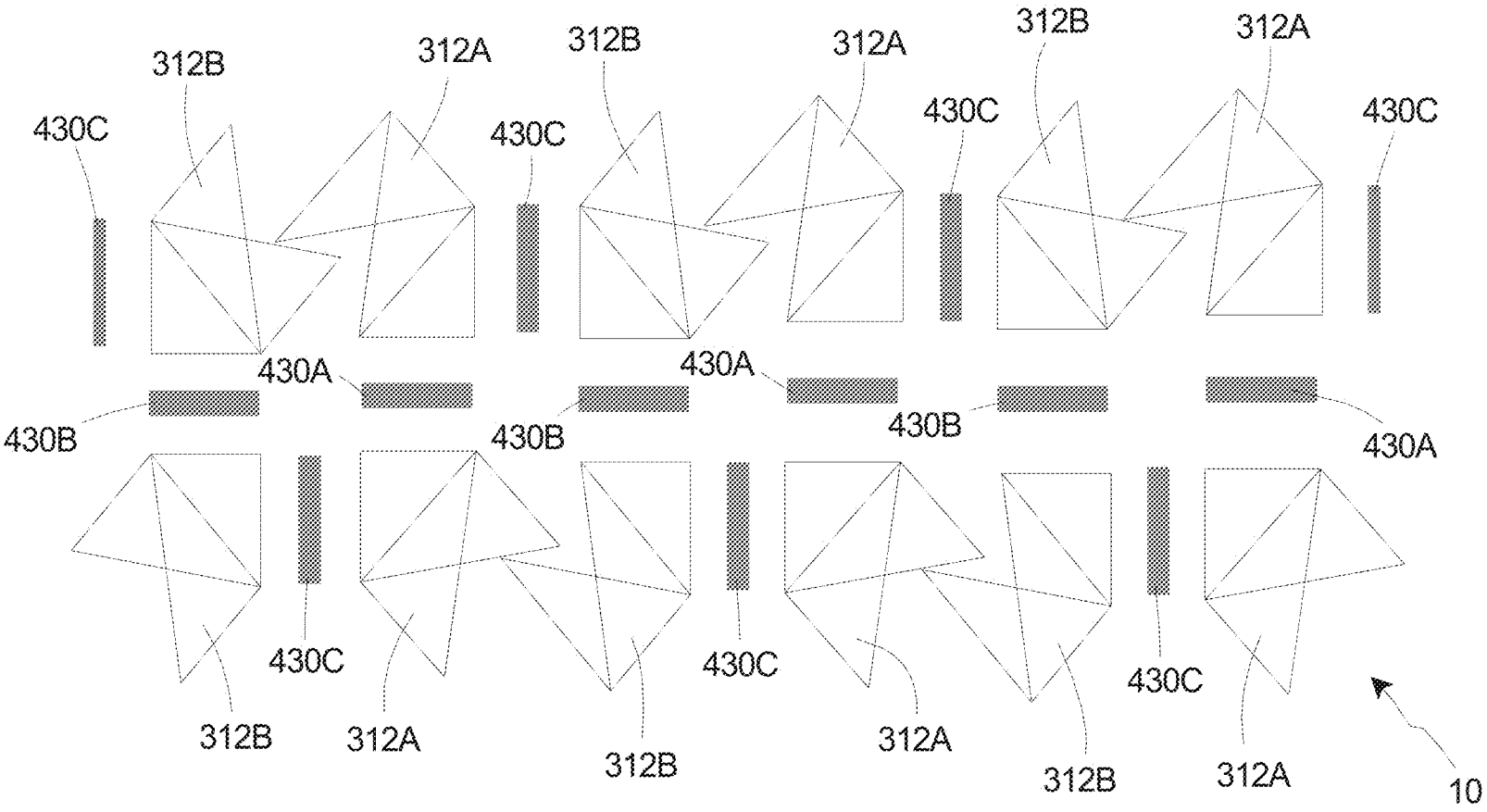
FIG. 5 is a simplified schematic top view of the geometric art toy illustrated in FIG. 1A, the geometric art toy including a plurality of toy members that are movably coupled to one another one or more first flexible connectors, one or more second flexible connectors, and one or more third flexible connectors.

FIG. 5 is a simplified schematic top view of the geometric art toy 10 illustrated in FIG. 1. As shown, the geometric art toy 10 includes a plurality of toy members, i.e. a plurality of first toy members 312A illustrated in FIG. 3A and a plurality of second toy members 312B illustrated in FIG. 3B, that are movably coupled to one another utilizing one or more first flexible connectors 430A, one or more second flexible connectors 430B, and one or more third flexible connectors 430C. More particularly, FIG. 5 illustrates an embodiment of a general schematic layout of the toy members 312A, 312B relative to one another in the formation of the art toy 10. As noted above, and as shown in FIG. 5, each of the one or more first flexible connectors 430A is utilized to movably couple two first toy members 312A together, each of the one or more second flexible connectors 430B is utilized to movably couple two second toy members 312B together, and each of the one or more third flexible connectors 430C is utilized to movably couple one first toy member 312A and one second toy member 312B together. It should be appreciated that since FIG. 5 is illustrating a three-dimensional connection scheme in a two-dimensional illustration, the third flexible connectors 430C illustrated at either end of the Figure are, in reality, a single third flexible connector 430C. Additionally, it should be understood that the individual toy members 312A, 312B are illustrated as being spaced apart from one another and spaced apart from the flexible connectors 430A, 430B, 430C for purposes of clarity, i.e. such that the various connections between adjacent toy members 312A, 312B can be more clearly demonstrated. Further, the first magnets 314A of the first toy members 312A and the second magnets 314B of the second toy members 312B have been omitted from FIG. 5 for purposes of clarity.

In the embodiment illustrated in FIG. 5, the art toy 10 includes six first toy members 312A and six second toy members 312B. Additionally, as shown, each of the first toy members 312A is movably coupled to one other first toy member 312A (i.e. with a first flexible connector 430A) and one second toy member 312B (i.e. with a third flexible connector 430C); and each of the second toy members 312B is movably coupled to one other second toy member 312B (i.e. with a second flexible connector 430B) and one first toy member 312A (i.e. with a third flexible connector 430C). Alternatively, the art toy 10 can include greater than six or less than six first toy members 312A, greater than six or less than six second toy members 312B, and/or the toy members 312A, 312B can be movably coupled to one another in a different manner.

Additionally, in this embodiment, the art toy 10 includes twelve total flexible connectors 430A, 430B, 430C. More particularly, as shown, the art toy 10 includes three first flexible connectors 430A, three second flexible connectors 430B and six third flexible connectors 430C. Alternatively, the art toy 10 can include greater than or less than twelve flexible connectors 430A, 430B, 430C, and/or the art toy 10 can include different numbers of individual flexible connectors 430A, 430B, 430C than specifically illustrated in FIG. 5.

FIGS. 6-11 illustrate various other potential configurations for the art toy 10. With the specific positioning and orientation of the magnets 314A, 314B and the flexible connectors 430A, 430B, 430C as described in detail herein above, the art toy 10 can be stably maintained in any of the other potential configurations as disclosed and/or illustrated.

Figure 6:
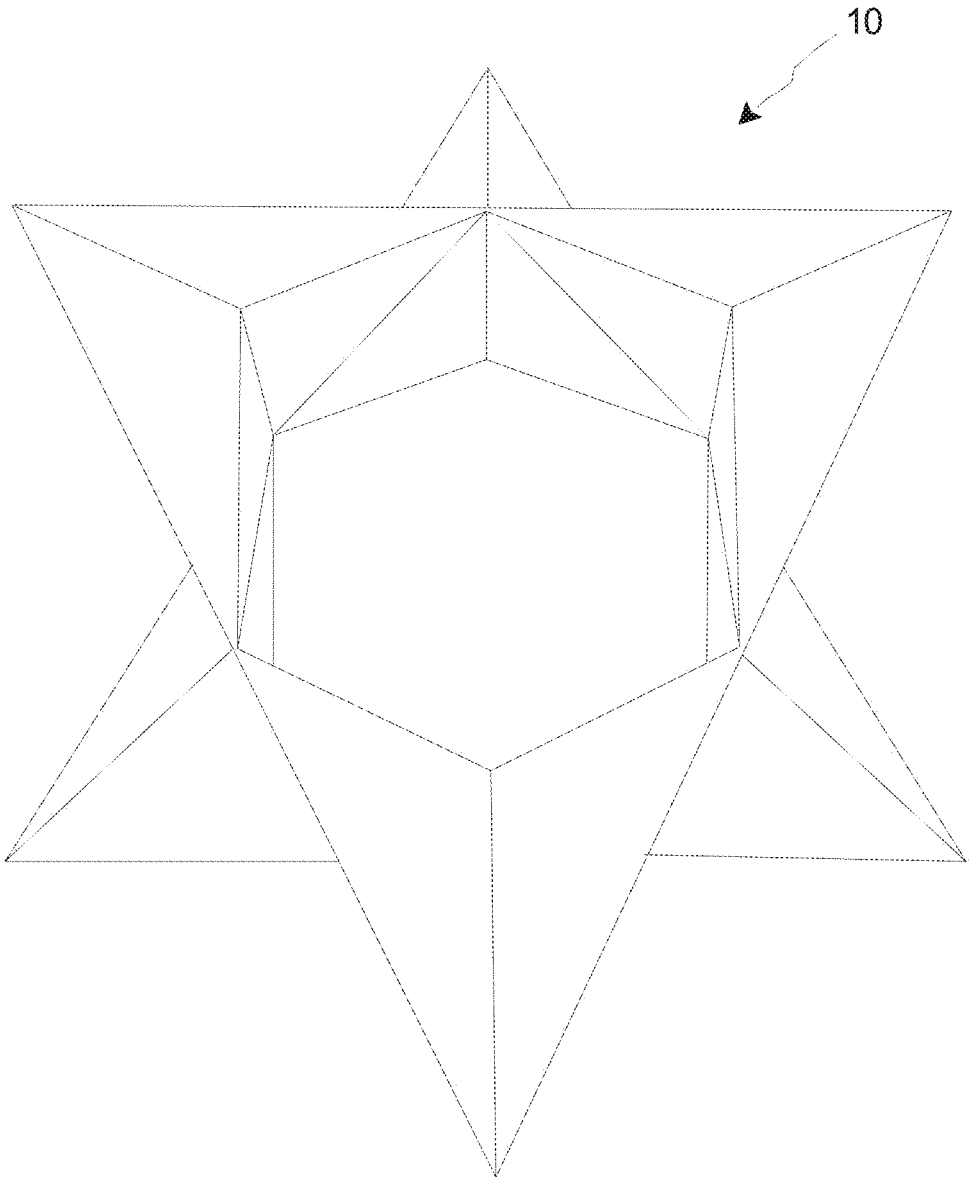
FIG. 6 is a perspective view of the geometric art toy illustrated in FIG. 1A, shown in a second configuration.
Figure 7:
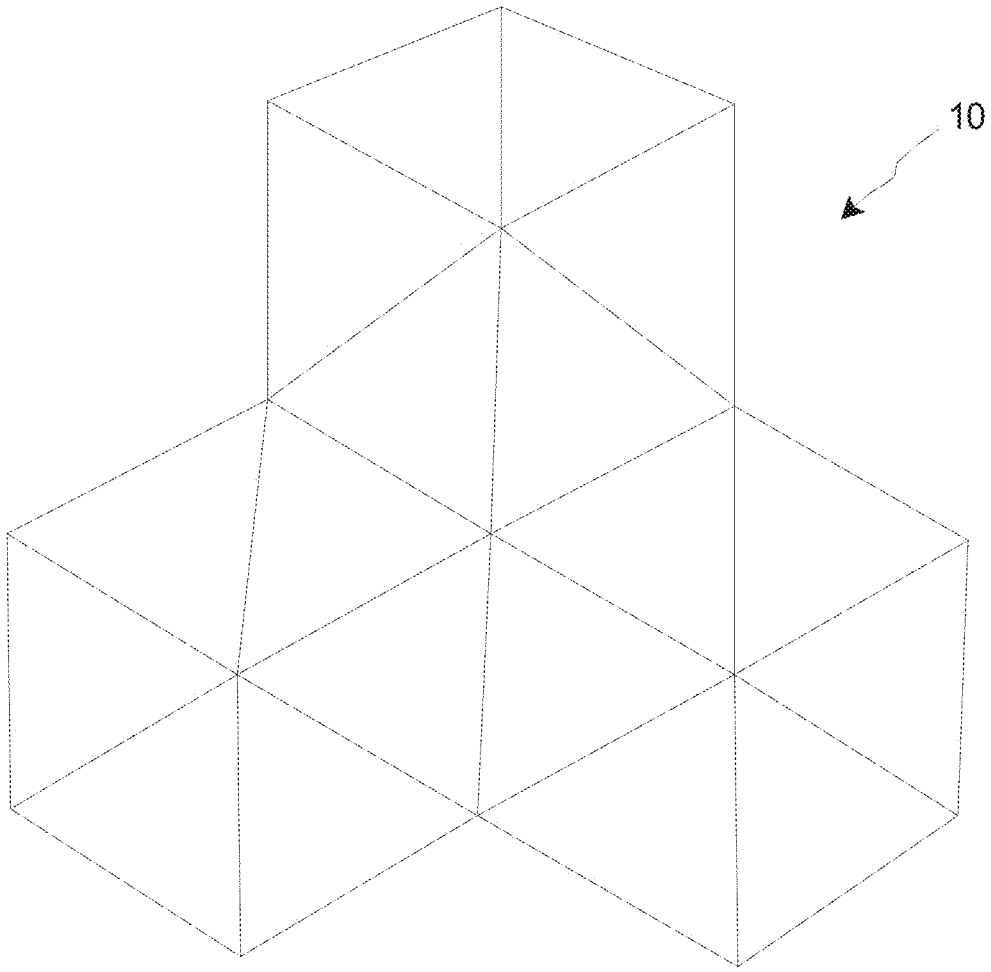
FIG. 7 is a perspective view of the geometric art toy illustrated in FIG. 1A, shown in a third configuration.
Figure 8:
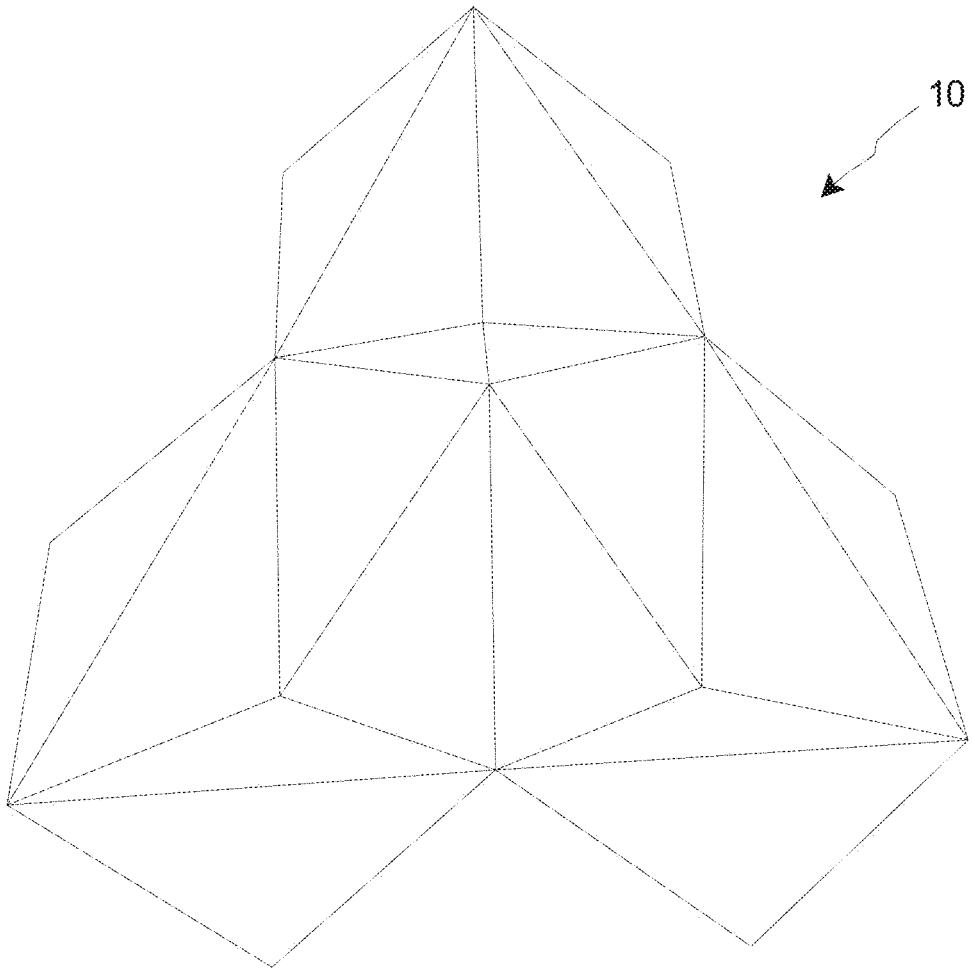
FIG. 8 is a perspective view of the geometric art toy illustrated in FIG. 1A, shown in a fourth configuration.
Figure 9:
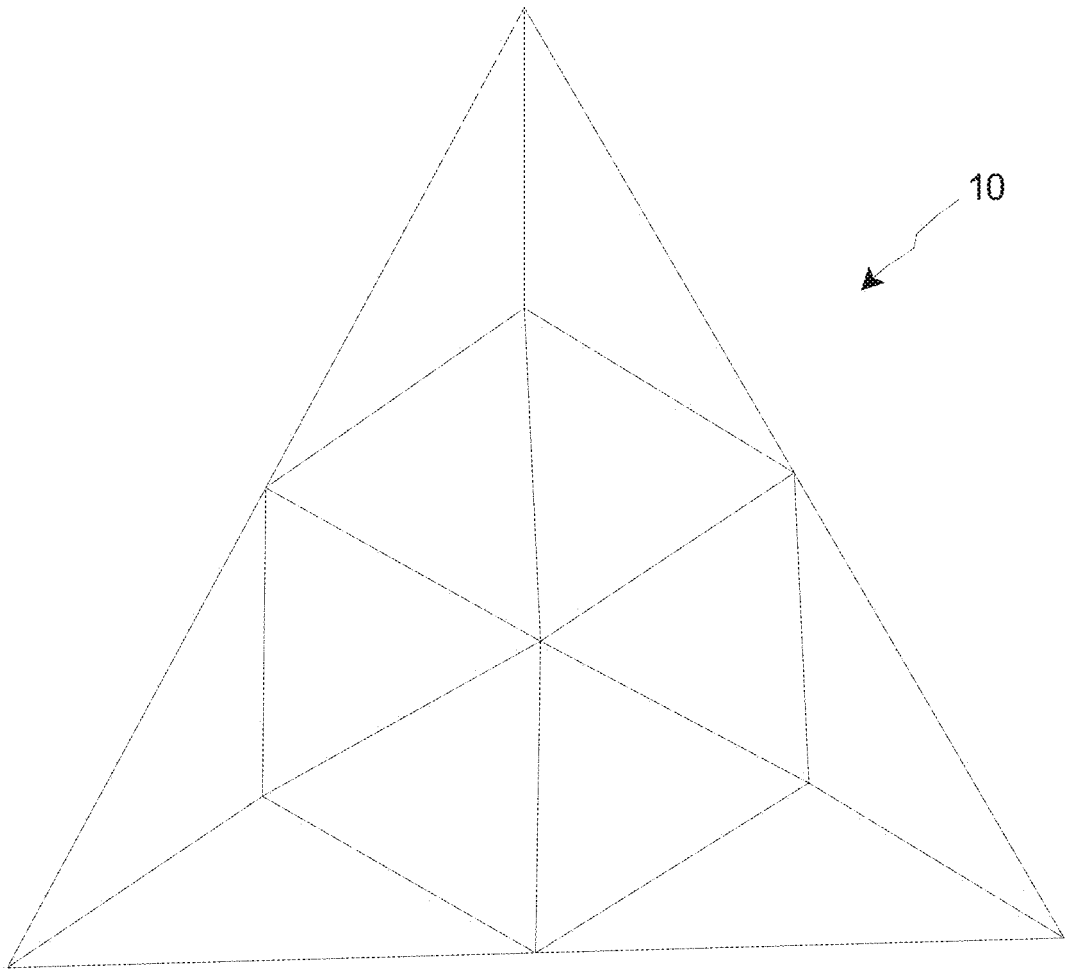
FIG. 9 is a perspective view of the geometric art toy illustrated in FIG. 1A, shown in a fifth configuration.
Figure 10:
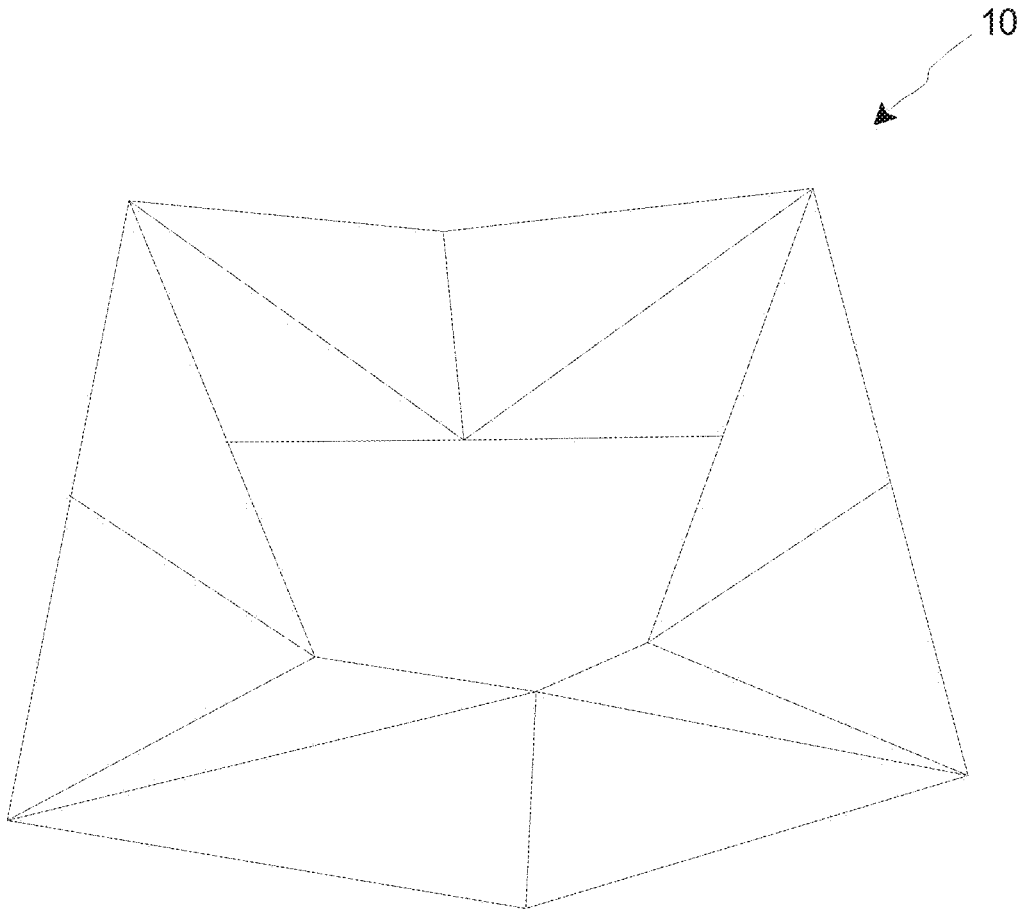
FIG. 10 is a perspective view of the geometric art toy illustrated in FIG. 1A, shown in a sixth configuration.
Figure 11:
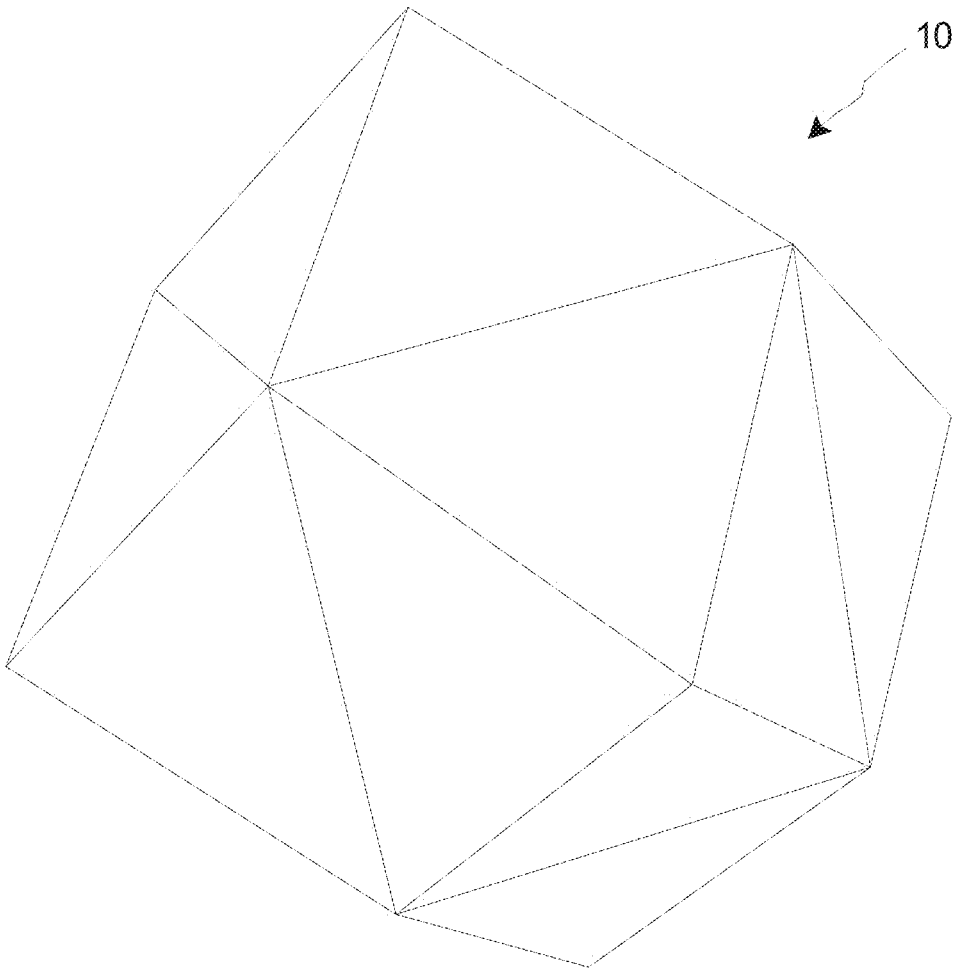
FIG. 11 is a perspective view of the geometric art toy illustrated in FIG. 1A, shown in a seventh configuration.

More particularly, FIG. 6 is a perspective view of the geometric art toy 10 illustrated in FIG. 1, the geometric art toy 10 being in a second configuration; FIG. 7 is a perspective view of the geometric art toy 10 illustrated in FIG. 1, the geometric art toy 10 being in a third configuration; FIG. 8 is a perspective view of the geometric art toy 10 illustrated in FIG. 1, the geometric art toy 10 being in a fourth configuration; FIG. 9 is a perspective view of the geometric art toy 10 illustrated in FIG. 1, the geometric art toy 10 being in a fifth configuration; FIG. 10 is a perspective view of the geometric art toy 10 illustrated in FIG. 1, the geometric art toy 10 being in a sixth configuration; and FIG. 11 is a perspective view of the geometric art toy 10 illustrated in FIG. 1, the geometric art toy 10 being in a seventh configuration.

During use of the art toy 10, the individual toy members 12 can be quickly and easily moved and manipulated relative to one another to enable the user to form the art toy 10 into any of the disclosed configurations. Moreover, as noted, the positioning, orientation and polarity of the magnets 14 within each of the toy members 12 enables the art toy 10 to be stably maintained in any such configurations. As such, the art toy 10 and the toy members 12 can be viewed as an educational device for the study of polygonal solids, as a puzzle or toy that can be used for entertainment or amusement, and/or as a work of art that can be displayed for others to see.

Figure 12:
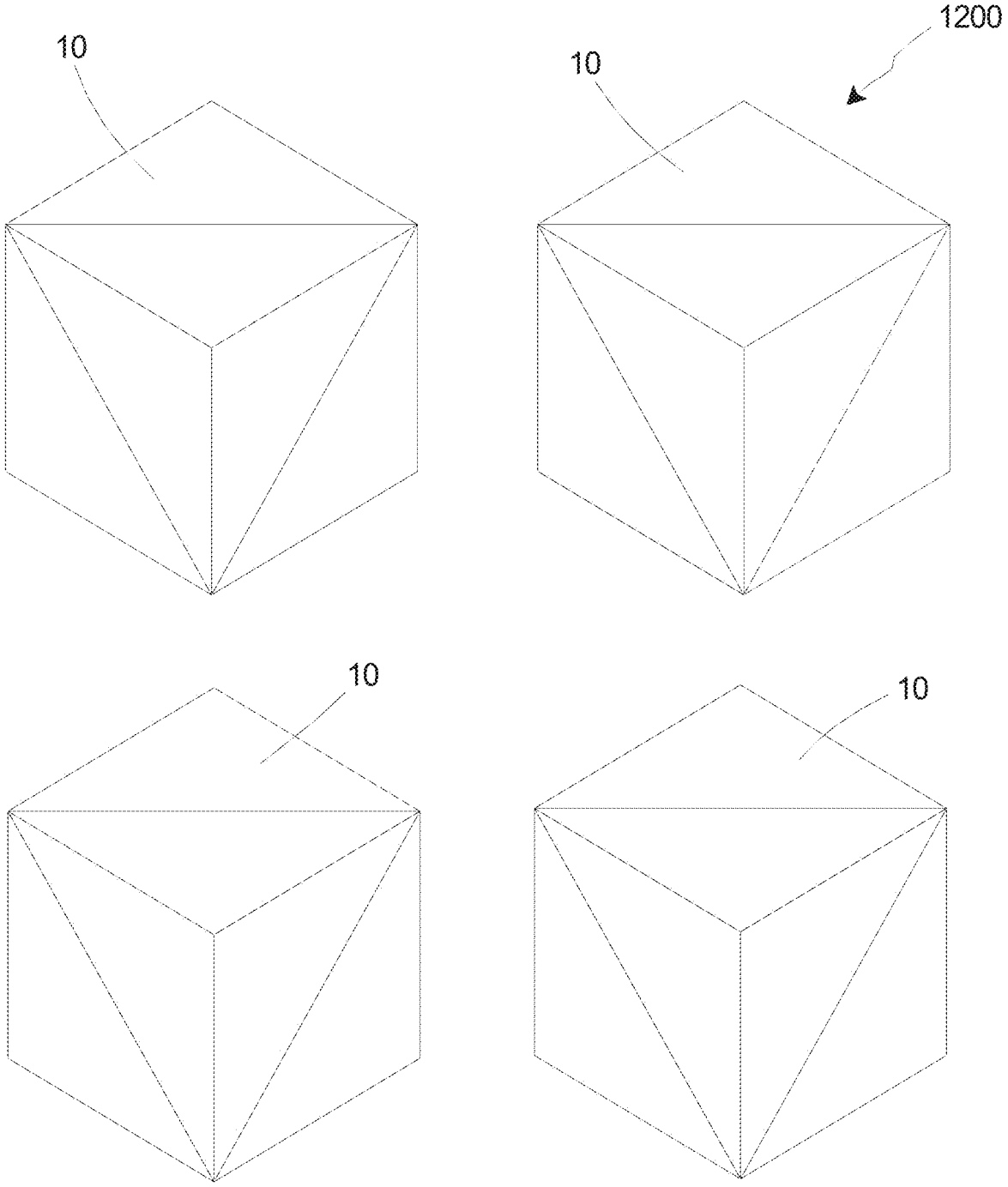
FIG. 12 is a perspective view of a toy assembly including a plurality of geometric art toys illustrated in FIG. 1A.

FIG. 12 is a perspective view of a toy assembly 1200 including a plurality of geometric art toys 10 illustrated in FIG. 1. For example, in some embodiments, as shown in FIG. 12, the toy assembly 1200 can include four geometric art toys 10. Alternatively, the toy assembly 1200 can be designed to include greater than four or less than four art toys 10.

Additionally, in one embodiment, each of the geometric art toys 10 within the toy assembly 1200 is substantially identical in design. Further, each of the geometric art toys 10 can be selectively and stably positioned in the various alternative configurations as illustrated and described above.

Moreover, based on the precise positioning, orientation and polarity of the magnets 314A, 314B (illustrated in FIGS. 3A and 3B, respectively), the geometric art toys 10 can be selectively and stably, i.e. magnetically, coupled together to form additional, alternative configurations with the toy assembly 1200. Additionally, various such additional, alternative configurations can by substantially symmetrical about one or more axes that extend through a center of the configuration. In various embodiments, each of the geometric art toys 10 can be positioned in the same individual configuration before the geometric art toys 10 are coupled together to form some of the additional, alternative configurations. Alternatively, one or more of the geometric art toys 10 can be positioned in different individual configurations before the geometric art toys 10 are coupled together to form others of the additional, alternative configurations.

During the development of the art toy 10 and/or the toy assembly 1200, it has been found that utilizing a number of art toys 10 of a multiple of four, results in a toy assembly 1200 that fall into a neat family of complexity. It should further be appreciated that with the addition of more and more art toys 10 to the toy assembly 1200, and with the precise positioning and orientation of the magnets 314A, 314B within each of the art toys 10, the toy assembly 1200 can thus be manipulated into almost an infinite number of stable configurations.

It is understood that although a number of different embodiments of art toys 10 and toy members 12 have been illustrated and described herein, one or more features of any one embodiment can be combined with one or more features of one or more of the other embodiments, provided that such combination satisfies the intent of the present invention.

While a number of exemplary aspects and embodiments of an art toy 10 and toy members 12 have been discussed above, those skilled in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A geometric art toy comprising:

six first toy members formed as tetrahedrons, each first toy member including three first magnets that are oriented to exhibit a first polarity, wherein the three first magnets are the only magnets of each first toy member and are coupled to three internal faces of each first toy member such that one internal face is without a first magnet coupled thereto; and six second toy members formed as tetrahedrons, each second toy member including three second magnets that are oriented to exhibit a second polarity that is substantially opposite to the first polarity, wherein the three second magnets are the only magnets of each second toy member and are coupled to three internal faces of each second toy member such that one internal face is without a second magnet coupled thereto;

wherein each first toy member is coupled to another first toy member and to one of the second toy members with a flexible adhesive, such that each first toy member is configured to magnetically couple with the second toy member to which it is coupled with the flexible adhesive, but not with the other first toy member to which it is coupled with the flexible adhesive.

2. The geometric art toy of claim 1, wherein each second toy member is coupled to another second toy member and to one of the first toy members with a second flexible adhesive.

3. The geometric art toy of claim 1, wherein a shape of the first toy member is substantially identical to a shape of the second toy member.

4. The geometric art toy of claim 1, wherein each first toy member has six edges, and the six edges comprises a first edge having a first length of one unit, a second edge having a second length of one unit, a third edge having a third length of square root of two ($\sqrt{/2}$) units, a fourth edge having a fourth length of one-half square root of three ($\sqrt{3/2}$) units, a fifth edge having a fifth length of one-half square root of three ($\sqrt{3/2}$) units, and a sixth edge having a sixth length of one-half square root of three ($\sqrt{3/2}$) units.

5. The geometric art toy of claim 1, wherein the geometric art toy is selectively and alternatively configurable between a first configuration and a second configuration, the second configuration being different than the first configuration.

6. The geometric art toy of claim 5, wherein the first magnets interact with the second magnets such that the geometric art toy is configured to be stably maintained in each of the first configuration and the second configuration.

7. The geometric art toy of claim 1, wherein the another first toy member is adjacent to the first toy member to which it is connected with the flexible adhesive, and the second toy member is adjacent to the first toy member to which it is connected with the flexible adhesive.

8. The geometric art toy of claim 1, wherein the flexible adhesive includes a plurality of flexible connectors.

9. The geometric art toy of claim 1, wherein the geometric art toy further comprises a display support, the display support being configured to support the first toy members and the second toy members relative to a surface.

10. A toy assembly comprising a plurality of the geometric art toys of claim 1, wherein each geometric art toy is selectively and magnetically coupled to another geometric art toy.

11. A geometric art toy comprising:

six first toy members, each first toy member being formed in a shape of a first tetrahedron, each first toy member including three first magnets that are the only magnets of that first toy member and are oriented to exhibit a first polarity, each first toy member including four surfaces, one of the three first magnets being coupled to an interior of each of three of the four surfaces such that one surface of the four surfaces is without a first magnet coupled thereto; and six second toy members that are coupled to the six first toy members, each second toy member being formed in a shape of a second tetrahedron, each second toy member including three second magnets that are the only magnets of each second toy member and are oriented to exhibit a second polarity that is substantially opposite to the first polarity, each second toy member including four surfaces, one of the three second magnets being coupled to an interior of each of three of the four surfaces such that one surface of the four surfaces is without a second magnet coupled thereto;

wherein a shape of the first tetrahedron is substantially identical to a shape of the second tetrahedron, and each of the first tetrahedron and the second tetrahedron has six edges including a first edge having a first length of one unit, a second edge having a second length of one unit, a third edge having a third length of square root of two ($\sqrt{/2}$) units, a fourth edge having a fourth length of one-half square root of three ($\sqrt{3/2}$) units, a fifth edge having a fifth length of one-half square root of three ($\sqrt{3/2}$) units, and a sixth edge having a sixth length of one-half square root of three ($\sqrt{3/2}$) units; and wherein each first toy member is coupled to an adjacent first toy member and to an adjacent second toy member such that each first toy member is configured to magnetically couple with the adjacent second toy member to which it is coupled, but to not magnetically couple with the adjacent first toy member to which it is coupled, and each second toy member is coupled to an adjacent second toy member and to an adjacent first toy member such that each second toy member is configured to magnetically couple with the adjacent first toy member to which it is coupled, but to not magnetically couple with the adjacent second toy member to which it is coupled, and the first toy members and the second toy members form a configuration with no interior voids between the first toy members and the second toy members.

* * * * *